US008651330B2

(12) United States Patent
Krause et al.

(10) Patent No.: US 8,651,330 B2
(45) Date of Patent: Feb. 18, 2014

(54) REFRIGERATION APPLIANCE WITH HOT WATER DISPENSER

(75) Inventors: Andrew Reinhard Krause, La Grange, KY (US); Robert Lee Lewis, Jr., Louisville, KY (US); Kevin Farrelly Nolan, Louisville, KY (US); Arun Talegaonkar, Louisville, KY (US); Alan Joseph Mitchell, Louisville, KY (US); Jeffrey Martin Wood, Louisville, KY (US); Lorina June White, Louisville, KY (US); Russell James Fallon, Louisville, KY (US); Jeffrey Michael Colyer, Allen Park, MI (US); Jason Andrew May, Prospect, KY (US)

(73) Assignee: General Electric Company, Schenectady, NY (US)

( * ) Notice: Subject to any disclaimer, the term of this patent is extended or adjusted under 35 U.S.C. 154(b) by 37 days.

(21) Appl. No.: 13/285,142

(22) Filed: Oct. 31, 2011

(65) Prior Publication Data

US 2013/0108249 A1 May 2, 2013

(51) Int. Cl.

| | |
|---|---|
| ***B67D 1/00*** | (2006.01) |
| ***B67D 7/14*** | (2010.01) |
| ***B67D 7/74*** | (2010.01) |
| ***B67D 7/06*** | (2010.01) |
| ***B67D 7/80*** | (2010.01) |

(52) U.S. Cl.

USPC ..... 222/69; 222/129; 222/144.5; 222/146.1

(58) Field of Classification Search

USPC ..... 222/52, 69, 129, 148, 189, 146.1, 222/146.2, 146.5, 146.6; 137/395, 398, 137/587, 589, 590, 592; 62/331, 390–391, 62/393, 454

See application file for complete search history.

(56) References Cited

U.S. PATENT DOCUMENTS

| | | | | | |
|---|---|---|---|---|---|
| 2,786,338 | A | * | 3/1957 | Wurtz et al. | 62/339 |
| 4,007,856 | A | * | 2/1977 | Murphy et al. | 222/67 |
| 4,391,459 | A | | 7/1983 | Wicke et al. | |
| 4,424,767 | A | | 1/1984 | Wicke et al. | |
| 4,513,887 | A | * | 4/1985 | Wicke et al. | 222/146.5 |
| 4,792,059 | A | * | 12/1988 | Kerner et al. | 222/67 |
| 5,139,708 | A | * | 8/1992 | Scott | 261/23.1 |
| 5,353,957 | A | * | 10/1994 | Campau | 222/1 |
| 5,823,007 | A | * | 10/1998 | Chang | 62/397 |
| 6,094,524 | A | | 7/2000 | Riley | |
| 6,196,162 | B1 | * | 3/2001 | Sparrowhawk | 122/13.3 |
| 6,207,046 | B1 | | 3/2001 | Yamashita et al. | |
| 6,453,955 | B1 | * | 9/2002 | Lee | 141/198 |
| 6,532,758 | B2 | * | 3/2003 | DuHack | 62/340 |

(Continued)

*Primary Examiner* — Paul R Durand
*Assistant Examiner* — Vishal Pancholi
(74) *Attorney, Agent, or Firm* — Dority & Manning, P.A.

(57) ABSTRACT

A refrigeration appliance with a hot water dispenser includes a refrigerated cabinet having a dispenser area, a cabinet water inlet in the refrigerated cabinet connectable to a premises water line, and a hot water storage tank. The tank has a tank body, a heater in the tank body, an inlet for admitting water into the tank body supplied via the cabinet water inlet, and an outlet for providing water via a dispensing conduit to a dispenser in the dispenser area. The inlet includes a venturi portion for creating a reduced pressure within the hot water storage tank via flow of water into the hot water storage tank. The reduced pressure communicates with the dispensing conduit via the outlet so that, after dispensing water remaining in the dispensing conduit is drawn toward the tank body. Refrigeration devices with premises line pressure water distribution systems are also disclosed.

17 Claims, 13 Drawing Sheets

(56) References Cited

U.S. PATENT DOCUMENTS

| | | | | |
|---|---|---|---|---|
| 7,043,150 | B2 | 5/2006 | Krause et al. | |
| 7,130,533 | B2 | 10/2006 | Kim et al. | |
| 7,137,272 | B2 | 11/2006 | Park et al. | |
| 7,610,849 | B2 | 11/2009 | Bigge et al. | |
| 2003/0159447 | A1* | 8/2003 | Sergio et al. | 62/3.64 |
| 2006/0059922 | A1* | 3/2006 | Anderson et al. | 62/93 |
| 2007/0084351 | A1 | 4/2007 | Chang et al. | |
| 2007/0251261 | A1 | 11/2007 | Son et al. | |
| 2009/0120122 | A1 | 5/2009 | Gradl et al. | |
| 2009/0126392 | A1* | 5/2009 | An et al. | 62/389 |
| 2009/0133430 | A1 | 5/2009 | Roetker et al. | |
| 2009/0159611 | A1 | 6/2009 | Roetker et al. | |
| 2009/0165494 | A1* | 7/2009 | Muthumani et al. | 62/390 |
| 2009/0249818 | A1 | 10/2009 | Kim | |
| 2009/0249821 | A1 | 10/2009 | Zentener et al. | |
| 2010/0154651 | A1* | 6/2010 | Skalski et al. | 99/302 R |
| 2011/0006080 | A1* | 1/2011 | Naylor et al. | 222/146.2 |

* cited by examiner

REFRIGERATION APPLIANCE WITH HOT WATER DISPENSER

FIELD OF THE INVENTION

The subject matter disclosed herein relates to hot water dispensing in refrigeration appliances.

BACKGROUND OF THE INVENTION

Various dispenser designs have been proposed for refrigeration appliances such as commercial or home refrigerators and/or freezers. In certain dispensers, ice cubes, hot water, and/or cold water can be provided to a user, often through a dispensing assembly in a front door. U.S. Patent App. Pub 2009/0249821 discloses a refrigeration appliance with one such dispensing device.

As refrigeration appliances have become more complex and feature rich, efforts have been made to optimize the functionality of such dispensing. Energy efficiency is a concern as well, as hot and cold water and ice all require a certain amount of energy to create and maintain. Cleanliness may also be important to address as some existing devices can be difficult to clean. Finally, some dispensers at times can provide a "dribble" of water after dispensing is done, for example comprised of left over liquid in a conduit downstream of a holding tank but upstream of a dispensing opening.

Accordingly, a multifunction dispenser that effectively and efficiently provides various products to a consumer in a user friendly fashion, addressing one or more problems of current devices or others, would be welcome.

BRIEF DESCRIPTION OF THE INVENTION

Aspects and advantages of the invention will be set forth in part in the following description, or may be obvious from the description, or may be learned through practice of the invention.

According to certain aspects of the disclosure, a refrigeration appliance with a hot water dispenser includes a refrigerated cabinet having a dispenser area, a cabinet water inlet in the refrigerated cabinet connectable to a premises water line, and a hot water storage tank. The tank has a tank body, a heater in the tank body, an inlet for admitting water into the tank body supplied via the cabinet water inlet, and an outlet for providing water via a dispensing conduit to a dispenser in the dispenser area. The inlet includes a venturi portion for creating a reduced pressure within the hot water storage tank via flow of water into the hot water storage tank. The reduced pressure is in communication with the dispensing conduit via the outlet so that, after dispensing operation is completed, water remaining in the dispensing conduit is drawn toward the tank body. Various options and modifications are possible.

According to certain other aspects of the disclosure, a refrigeration appliance with a water management and dispensing system connectable to a premises water line at a premises line pressure includes a refrigerated cabinet having a cold water storage tank, and a cabinet water inlet in the refrigerated cabinet connectable to the premises water line. The cabinet water inlet is in communication with an inlet of a cold water storage tank, the cold water storage tank having an outlet in communication with valving to divide flow from the cold water storage tank into a plurality of conduits. Each respective conduit leads to one of a cold water dispenser, a hot water source, and an ice maker. The valving is selectively openable to distribute water from the cold water storage tank to a selected one of the conduits via the premises line pressure without further pumping. Again, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
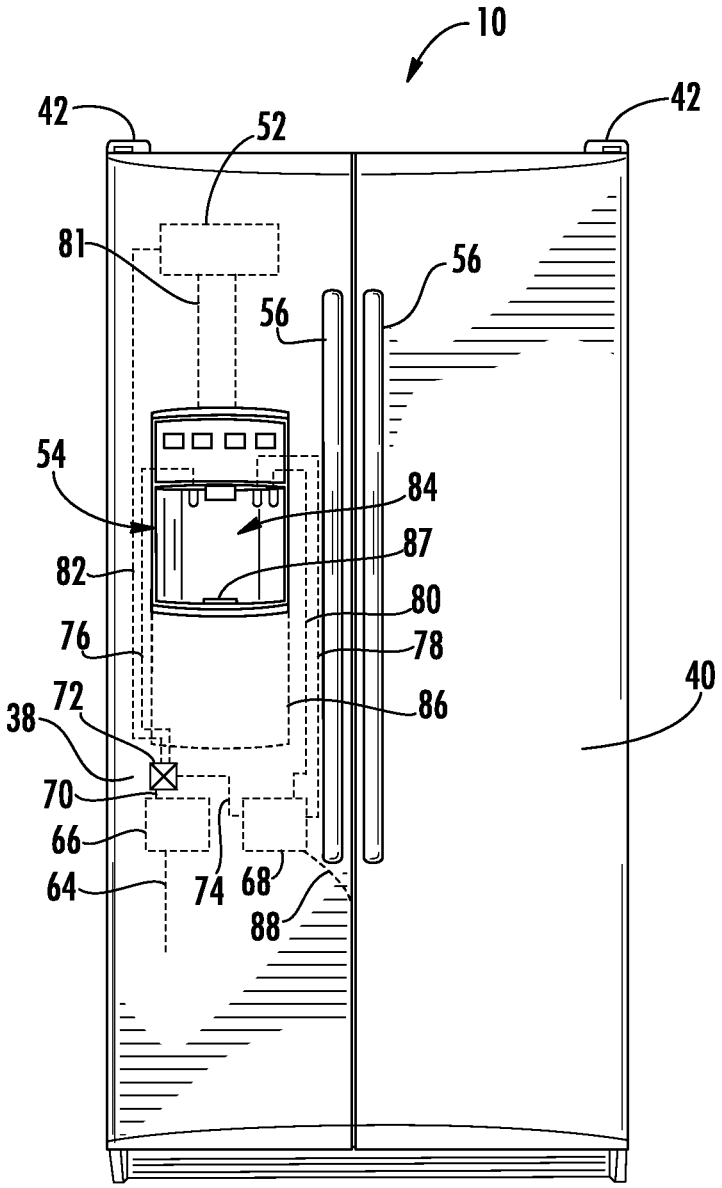
FIG. 1 provides a front view of a refrigeration appliance with its doors closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of an exemplary refrigeration appliance 10 depicted as a side by side refrigerator in which dispenser structures in accordance with aspects of the present disclosure may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth.

Figure 2:
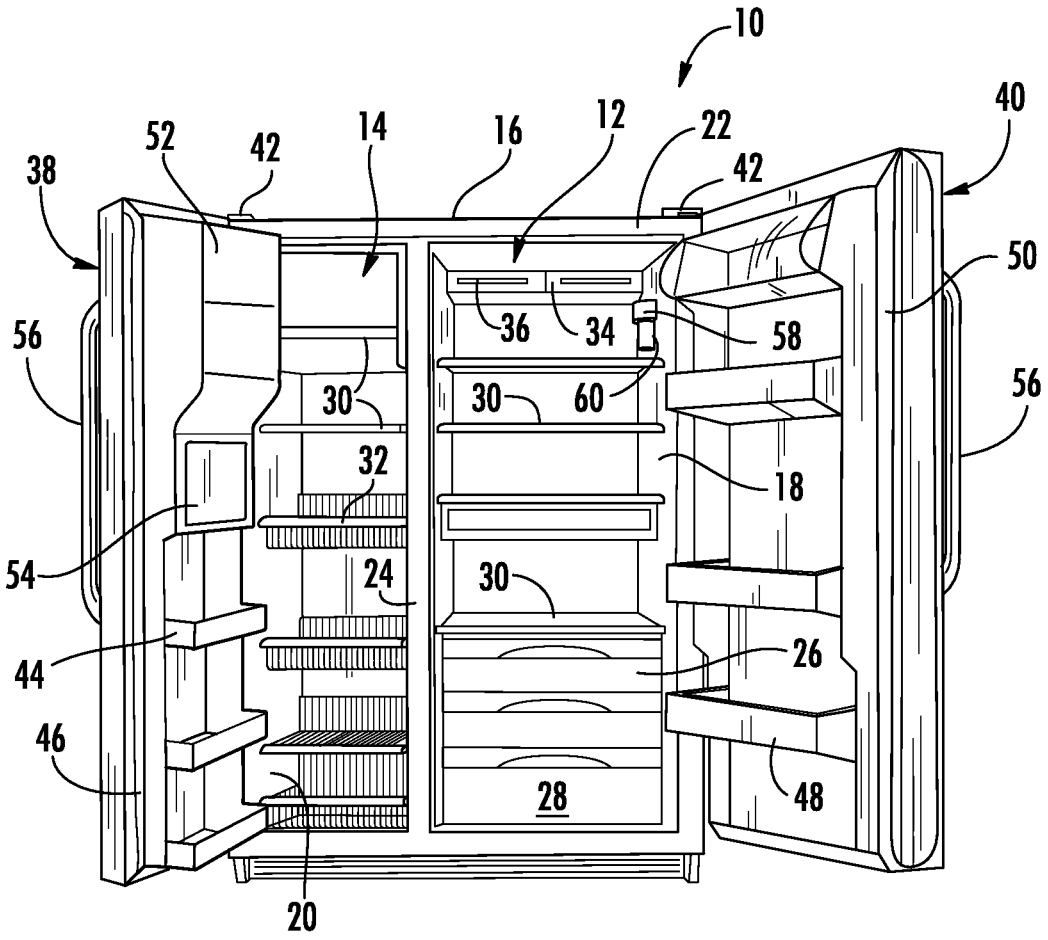
FIG. 2 provides a front view of the refrigeration appliance of FIG. 1 with its doors opened.

Referring to FIG. 2, the refrigerator 10 comprises a refrigerated cabinet including a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Slide-out drawers 26, a storage bin 28 and shelves 30 are normally provided in fresh food storage compartment 12 to support items being stored therein. In addition, at least one shelf 30 and at least one wire basket 32 are also provided in freezer storage compartment 14.

The refrigerator features are controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between an open position, as shown in FIG. 1, and a closed position. The freezer door 38 may include a plurality of storage shelves 44 and a sealing gasket 46, and fresh food door 40 also includes a plurality of storage shelves 48 and a sealing gasket 50.

The freezer storage compartment 14 may include an automatic ice maker 52 and a dispenser 54 provided in the freezer door 38 such that ice and/or chilled water can be dispensed without opening the freezer door 38, as is well known in the art. Doors 38 and 40 may be opened by handles 56 is conventional. A housing 58 may hold a water filter 60 used to filter water for the ice maker 52 and/or dispenser 54, although filter 60 may be located in other locations, such as within one of doors 38 or 40, as discussed below.

As with known refrigerators, the refrigerator 10 also includes a machinery compartment 63 (see FIG. 3) that at least partially contains components of refrigeration equipment 65 for executing a known vapor compression cycle for cooling air. The components include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to direct cool the ice maker to form ice cubes, and a heating loop can be added to help remove ice from the ice maker. Collectively, the vapor compression cycle components in a refrigeration circuit, associated fans, and associated compartments are conventionally referred to as a sealed system. The construction and operation of the sealed system are well known to those skilled in the art.

Figure 3:
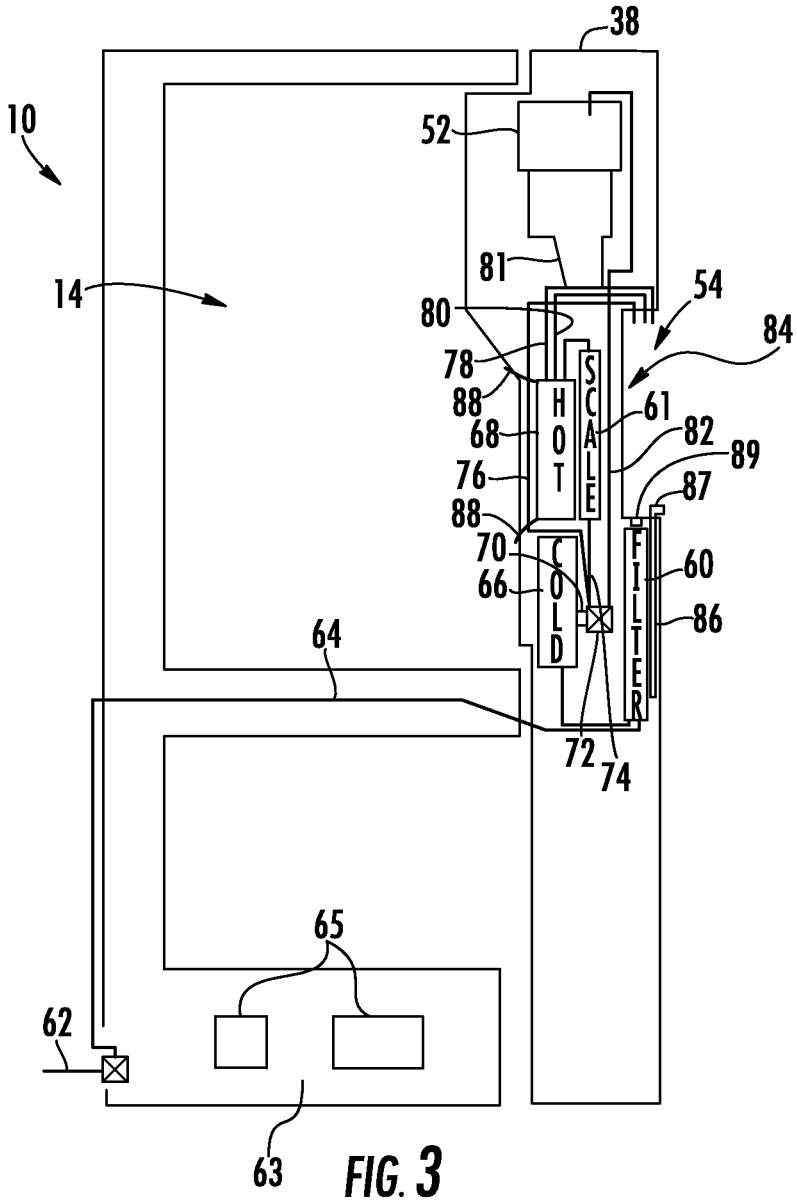
FIG. 3 provides a diagrammatical side view of the refrigeration appliance of FIG. 1, showing a water system according to certain aspects of the disclosure.

As shown in FIG. 3, refrigeration appliance 10 comprises a refrigerated cabinet including a cooled storage compartment, in this case freezer compartment 14. Door 38 closes compartment 14, with dispenser 54 in an outer surface of the door. A water supply 62 is provided with an inlet portion 64 in communication with a cold water storage tank 66. Water supply 62 is at premises line pressure which can vary, for example, between about 20 and 120 psig. Typical premises line pressures are in the range of about 60 psig.

As shown, tank 66 is within door 38. Filter 60 is shown as within door 38 between inlet portion 64 and cold water storage tank 66 as well, but could be within the refrigeration appliance case, if desired. Also shown within door 38 are hot water storage tank 68 and ice maker 52. It should be understood that either of these elements could be located elsewhere as well. An optional anti-scaling device 61 could also be provided in the system if desired, in particular if water heating is to be performed.

As to valving and routing of flow, if desired, cold water storage tank 66 may have an outlet 70 in communication with valving 72 to divide flow from the cold water storage tank into at least two flows: a first of the two flows being directed via a conduit 74 to hot water storage tank 68, a second of the two flows being directed via a conduit 76 to dispenser 54 for dispensing chilled water Conduit 78 places hot water tank 68 in communication with dispenser 54 for dispensing hot water, while optional conduit 80 does so for dispensing steam (for cleaning purposes). Valving 72 can also divide the flow from cold water storage tank 66 into a third flow which is directed via conduit 82 to ice maker 52. Ice bucket passage 81 allows ice cubes to be dispensed though dispenser 54. Accordingly, if all such functionality is provided, hot water, cold water, ice cubes and steam may be dispensed in dispenser 54, although all such items need not be used in any given application.

If desired, dispenser 54 may be cleanable via steam. If so, interior area 84 can be coverable by a slidable or pivotable cover 86 having a handle 87. Steam can thus be provided via conduit 80 to the dispenser interior area 84 for cleaning when the interior area is covered by cover 86. For safety purposes, a sensor 89 can be provided to sense whether cover 86 is in a closed position, whereby the steam function is disabled by controller 34 unless the sensor senses that the cover is in the closed position.

It may be desired to assist in removal of heat from hot water storage tank 68, to reduce energy required to chill the refrigeration appliance in general. Accordingly, a heat transfer element 88 may be provided (schematically shown in FIG. 3) for removing heat generated by the heating device in the tank 68. Element 88 may be at least one of a metallic tape or a foil adhesive for moving heat to the mullion or other exterior area of refrigerated appliance 10. If tank 68 is located in a door, the door mullion area 24 would be a likely location for the element to draw heat toward for exiting into the environment.

Figure 4:
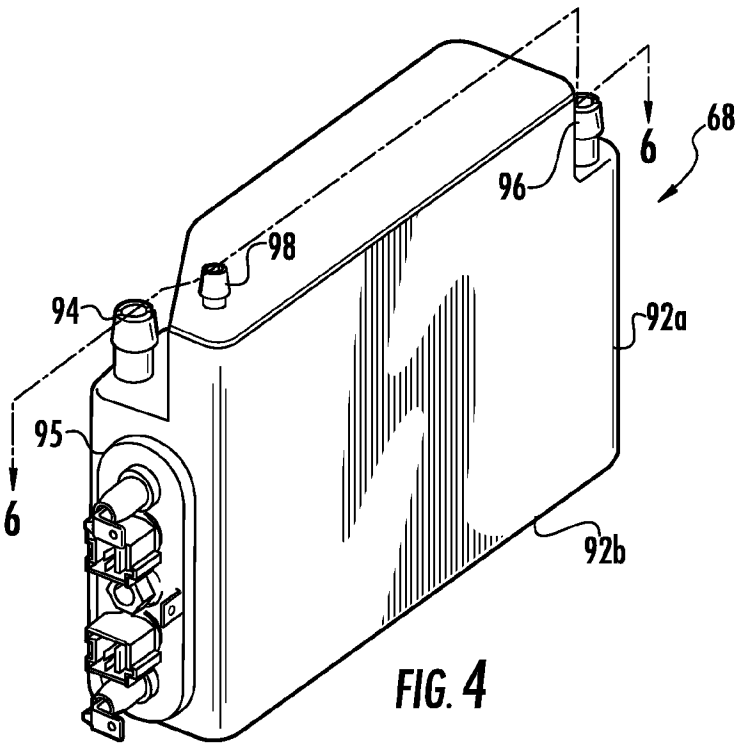
FIG. 4 provides a perspective view the hot water tank of FIG. 4.
Figure 5:
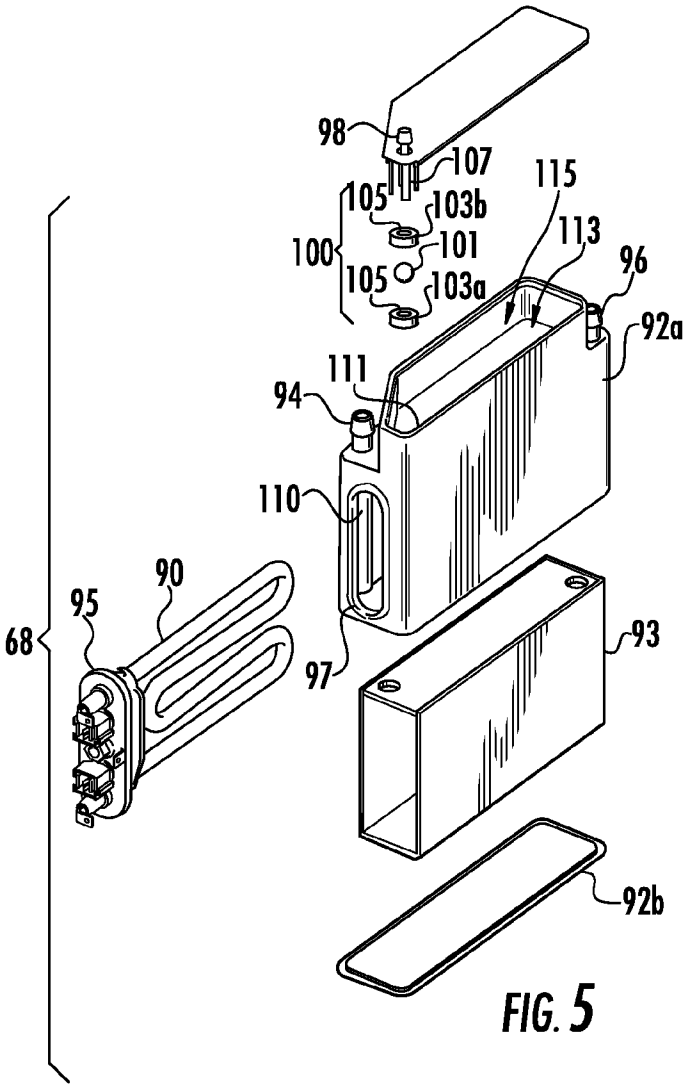
FIG. 5 provides an exploded perspective of one possible hot water tank.
Figure 6:
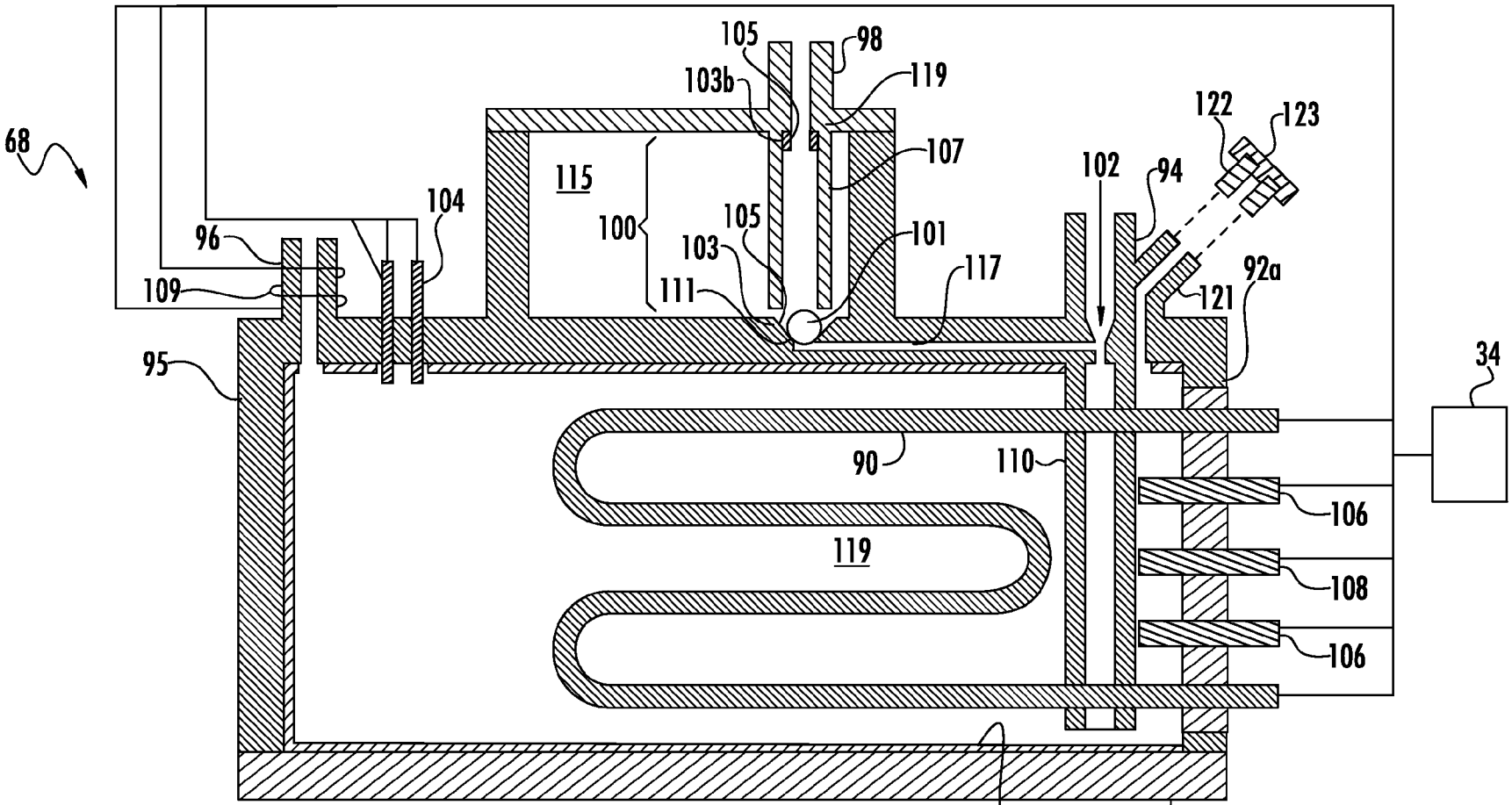
FIG. 6 provides a diagrammatical sectional view of a hot water tank having features of that in FIG. 4 in an initial empty condition.

Various arrangements are possible for the cold and hot water storage tanks. As shown in FIGS. 4-6, hot water tank 68 may include a heater 90 located within a tank body 92*a* and 92*b*. Tank body portions 92*a*, 92*b* may be made of a plastic such as polyethersulfone and the like, and the portions may be connected by ultrasonic, thermal welding, etc. A metallic liner 93 may be provided to shield tank body portions 92*a*, 92*b* from heater 90, which may be an electrical resistance heating device, a microwave heating device, or an induction heating device. Heater 90 includes a base 95 mountable in an opening 97 in tank body portion 92*a*. Accordingly, heater 90 and other elements attached to base may be moved for service or replacement.

An inlet 94, an outlet 96, and a venting outlet 98 with an overpressure check valve 100 are also provided. Valve 100 includes a float body 101, seals 103*a* and 103*b* each defining an opening 105 closeable by float body 101, and guides 107. (FIG. 6 shows seal 103*a* replaced by a cone). Opening 105 in seal 103*a* is in communication with opening 111 in floor 113 of evacuation chamber 115, further communicating with a conduit 117 extending to venturi portion 102 of inlet 94. Float body 101 will float upward and contact seal 103*b* to seal openings 105 and 119 to thereby close vent outlet 98 if chamber 115 is filled with water, this could occur, for example, as a safety feature if tank 92 is overfilled or overheated, if an upstream valve does not close properly, etc. Venting outlet 98 at the top of the tank assembly is provided in case of overpressure (during heating of water for example), to allow air to flow into chamber 115 during flow into tank 119, and to allow the evacuation chamber to fill with water after dispensing, as described below. Gas, not liquid, should therefore vent out outlet 98 past valve 100. A downtube 110 may be provided below inlet 94 for flow control, thermal mixing, splash reduction etc., so that input water (likely cool) is directed to the heating element 90 and away from outlet 96.

The inlet 94 includes a conventional venturi section 102 for creating a reduced pressure relative to a supplied premises line pressure (upstream from inlet) within the tank body interior 119 during flow. The venturi portion 102 also creates a pressure in conduit 117 lower than atmosphere during flow, thereby drawing water from evacuation chamber 115 into tank interior 119 (with some air being drawn through vent outlet 98 into evacuation chamber 115 at that time). Once dispensing stops, an upstream valve such as valve 72 is closed and pressure in tank interior 119 is above atmosphere (but below premises line pressure). Water in tank interior 119 therefore travels into conduit 117 and into evacuation chamber 115 which is vented to atmosphere. Water located between dispenser 54 and outlet 96 will travel back into tank body 92 in conduit 78 by virtue of the flow from tank body 119 into evacuation chamber 115, thereby reducing or preventing trickle or drips at dispenser 54. Alternatively, or in addition, tank body 92 may be located below dispenser 54, so that gravity assists in drawing water from conduit 78 and outlet 96 back into the tank body.

Hot water tank 68 may have controls such as water level sensors 104 and a temperature sensing thermistors 106 for typical system control, and a temperature cut off sensor 108 to disable heater 90 as a safety device in case of overheating. All such devices, as well as pumps, valving controls, and other electromechanical elements can be connected electrically to controller 34. However, conventional devices such as smaller mini-controllers, circuit boards, solid state control devices, can also be provided at one or more locations within refrigeration appliance 10, such as on base 95 to create a modular device with onboard control hardware and programming.

Instead of providing an in-line descaling device such as element 61 (see FIG. 3), a descaling inlet port 121 may be provided to the tank (see FIG. 6). Port 121 may be connected to a user reachable fill port 122 with a removable cover 123, for example in door 38, mullion area, etc., for insertion of descaling liquid periodically. A reminder could be generated periodically by a display element in the dispenser area, such as a light, led or lcd indication, etc., that descaling liquid should be added. The reminder could be generated after a period of time, after an amount of use of hot water, after an amount of energy has been used to create hot water, etc.

Hot water tank 68 may be operated in various ways. It may keep a supply of hot water at the ready. To conserve energy, it may instead hold water at the ready, but unheated, so that water is only heated when desired. It may remain mostly empty until heated water is desired, at which point water is supplied and heated. Steam may be provided by heater 90, or hot water may be provided by the heater, and a supplemental heater 109 downstream of tank 68 may heat the hot water further to make the steam. The present disclosure envisions any such scenario or others. There may be one outlet 96 for hot water and steam leading to one conduit or separate conduits, with or without valving, or separate outlets for each.

Figure 7:
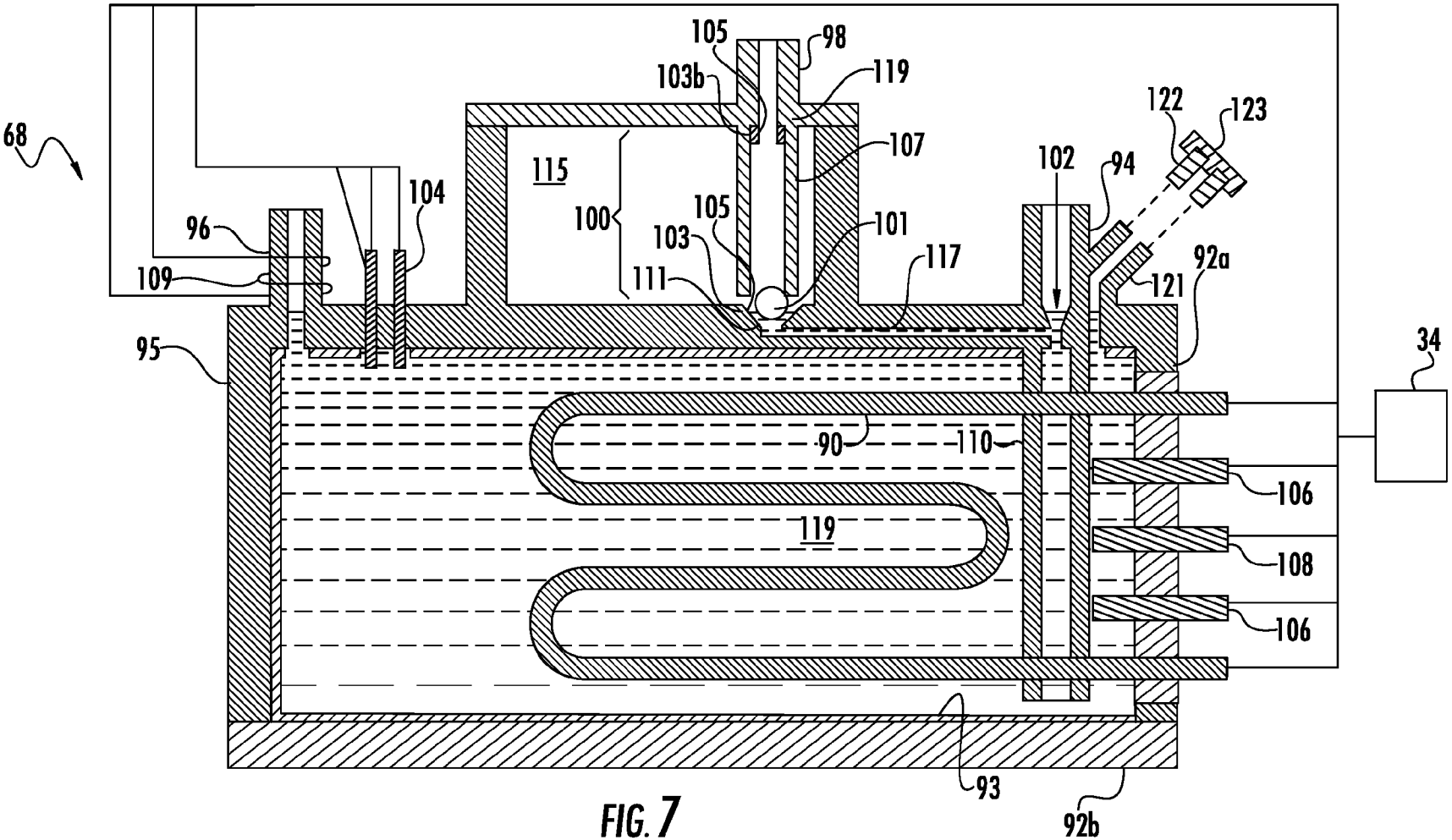
FIG. 7 provides a diagrammatical sectional view of a hot water tank having features of that in FIG. 4 in an initial filled condition.

FIGS. 6-9 depict a water cycle in the tank. FIG. 6 shows an initial empty condition that occurs for example when the refrigeration appliance is installed or initiated after cleaning or service. Sensors 104 indicate that no water is present at the top of tank 68, so an upstream valve such as valve 72 is opened allowing flow of water into inlet 102. Flow occurs until the tank is full, as indicated by sensors 104 sensing water present, as shown in FIG. 7. Some water will have flowed into outlet 96, conduit 117, and perhaps evacuation chamber 115 at this point as well.

If a user wishes to get hot water, the user will indicate such on the dispenser interface, as described below. If no water is in the tank or the tank is not full as sensed by sensors, the tank will be filled to the condition of FIG. 7. Once sensors 104 sense that the tank is full, heater 90 is activated to heat the water for a period of time to reach the temperature indicated by the user, as will be described below. Once the desired temperature is reached, an indication is given to the user and the user can manipulate an interface on the dispenser causing the valve upstream of inlet 94 to be reopened. Water is fed into inlet 94 again, which can be done at premises line pressure (e.g., 20-120 psig) without additional pumping. The water flows into tank 68 through venturi portion 102, creating a pressure in tank interior 119 below premises line pressure but above atmosphere and drawing water back from evacuation chamber 115 and conduit 117 via below atmosphere pressure created in conduit 117 by the venturi portion.

The venturi portion dimensions can readily be selected so that the resulting pressure drop within the tank and the suction applied to the evacuation chamber cause the desired functions. For example, a venturi can be designed for a premises line pressure of about 60 psig so as to create a tank pressure drop in the range of 8-10 psi and suction (negative pressure) in the range of 14-21 psi in the conduit to the evacuation chamber. However, if the premises line pressure were known to be, for example, closer to 20 or 120 psig, then a differently dimensioned venturi might be called for. It is within the level of skill in the art to design a venturi that can produce both a pressure drop within the tank small enough to allow water dispensing, and also enough suction to withdraw water from the evacuation chamber.

Figure 8:
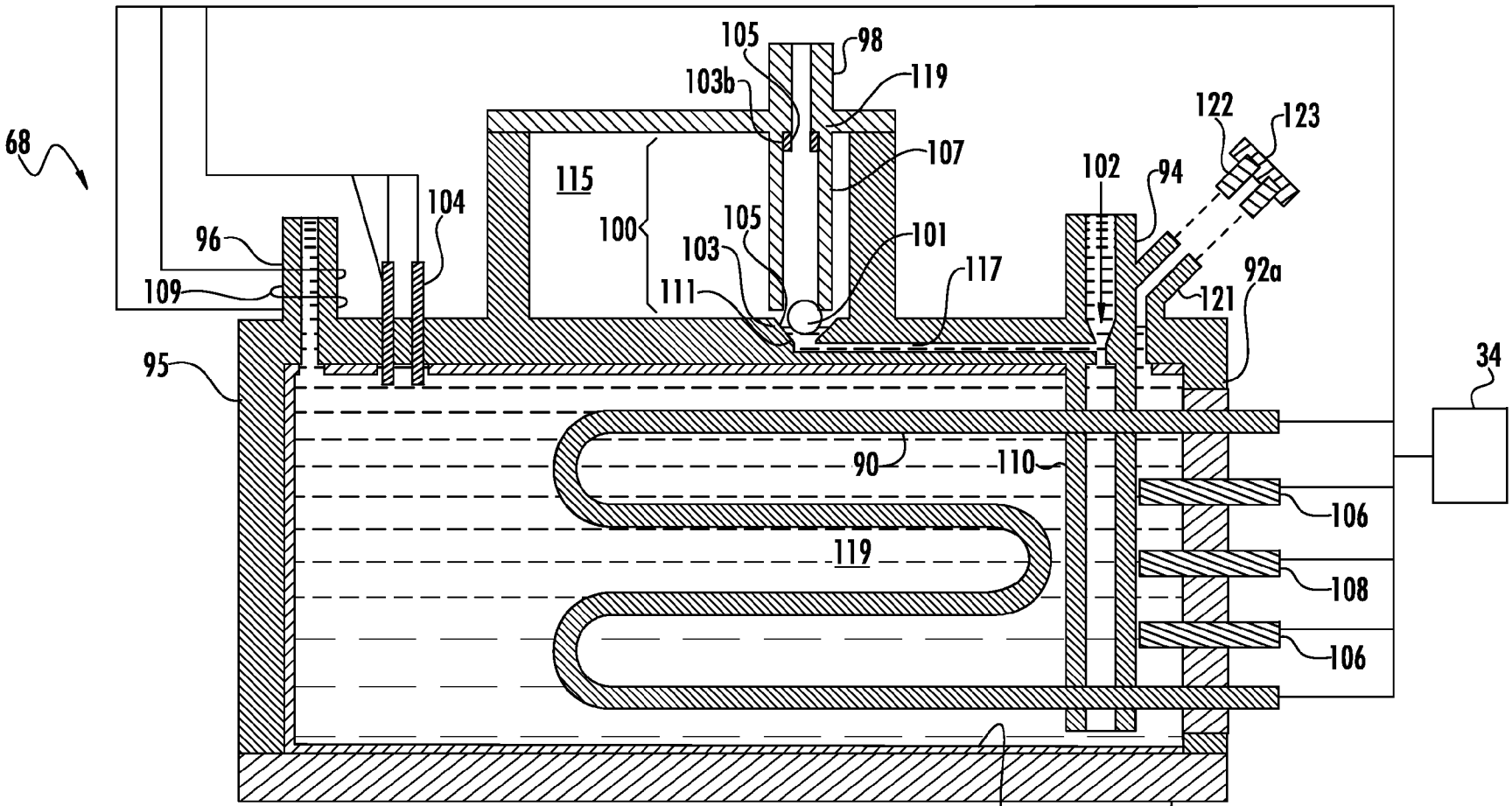
FIG. 8 provides a diagrammatical sectional view of a hot water tank having features of that in FIG. 4 in a dispensing condition.
Figure 9:
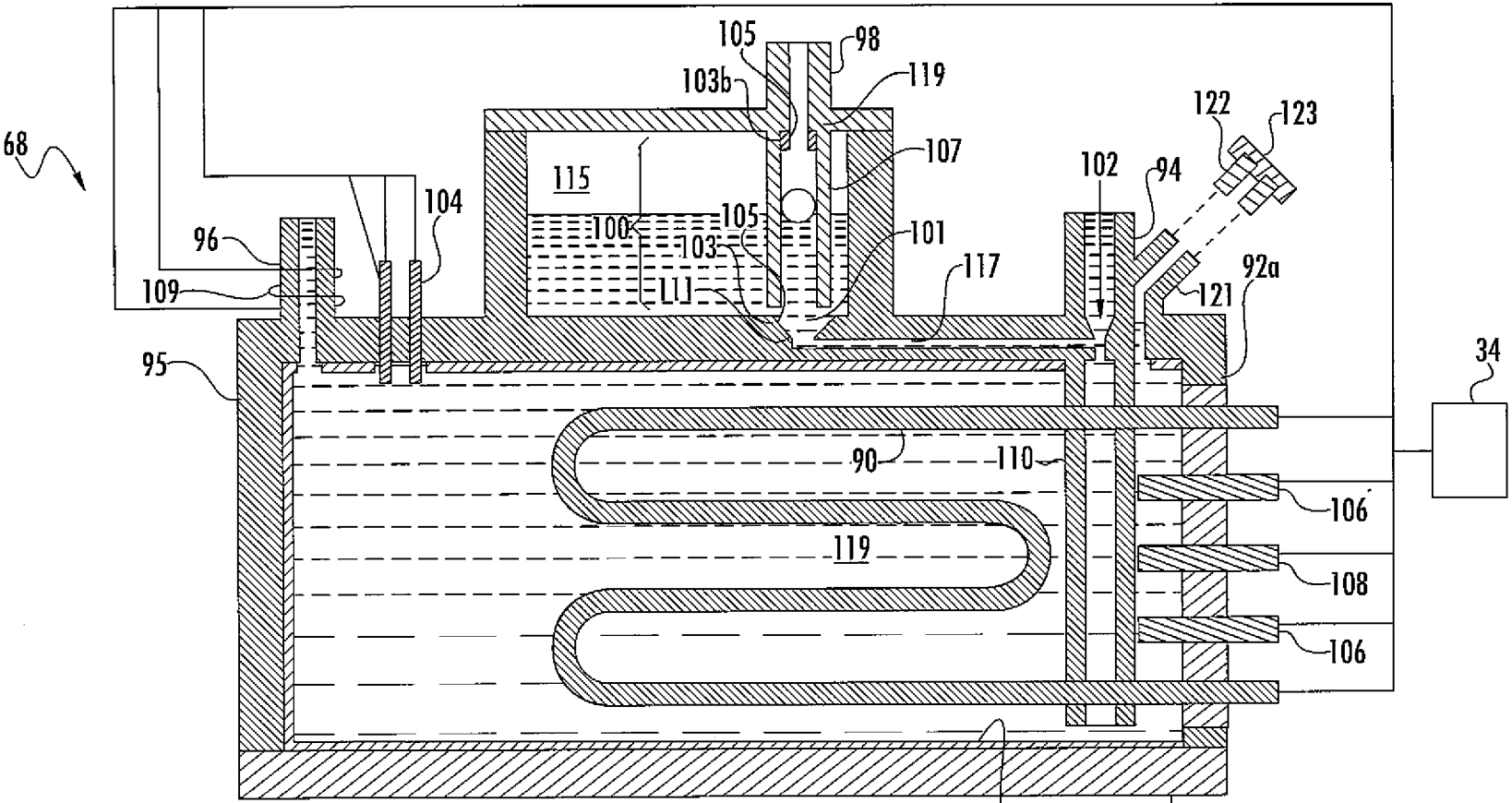
FIG. 9 provides a diagrammatical sectional view of a hot water tank having features of that in FIG. 4 in a post-dispensing condition.

Heated water simultaneously exits tank interior via outlet 96 and is fed via conduit 78 to dispenser 54 until the desired amount is dispensed. Liquid levels during dispensing (once water has been pulled from conduit 117) are as shown in FIG. 8 with flow into inlet 94 and out outlet 96.

When dispensing ends, either automatically or by choice of user if earlier, an amount of heated water will be located between outlet 96 and dispenser 54 in conduit 78. The upstream valve is closed again. A pressure exists in tank interior 119 above atmosphere and valve 100 is openable to vent the pressure as flow in the venturi portion 102 has stopped. Accordingly, water in conduit 78 flows back into tank interior 119, perhaps assisted by gravity if tank 68 is below dispenser 54, through conduit 117 to evacuation chamber 115 which is vented to atmosphere via port 98. Water will therefore flow into chamber 115 causing float member 101 to rise within guides 107 of valve 100. Because the volume of evacuation chamber 115 and conduit 117 designed to be greater than the volume of conduit 78, water will flow back into chamber 115 and reach a new equilibrium in the position shown in FIG. 9 without overflowing the evacuation chamber.

When a user again desires heated water, heater element 90 will again be activated for a time, and then the upstream valve can be opened allowing flow into interior 119. Venturi portion 102 will again cause suction in conduit 117 that will draw air into evacuation chamber 115 and water out of the evacuation chamber via conduit 117. Eventually, the tank will substantially reach the dispensing condition of FIG. 8, although all water need not be drained from evacuation chamber 115. Once dispensing is complete, when the water will return substantially to the position of FIG. 9. The water tank 68 will then generally cycle between the positions of FIGS. 8 and 9 as more heated water is dispensed.

Figure 10:
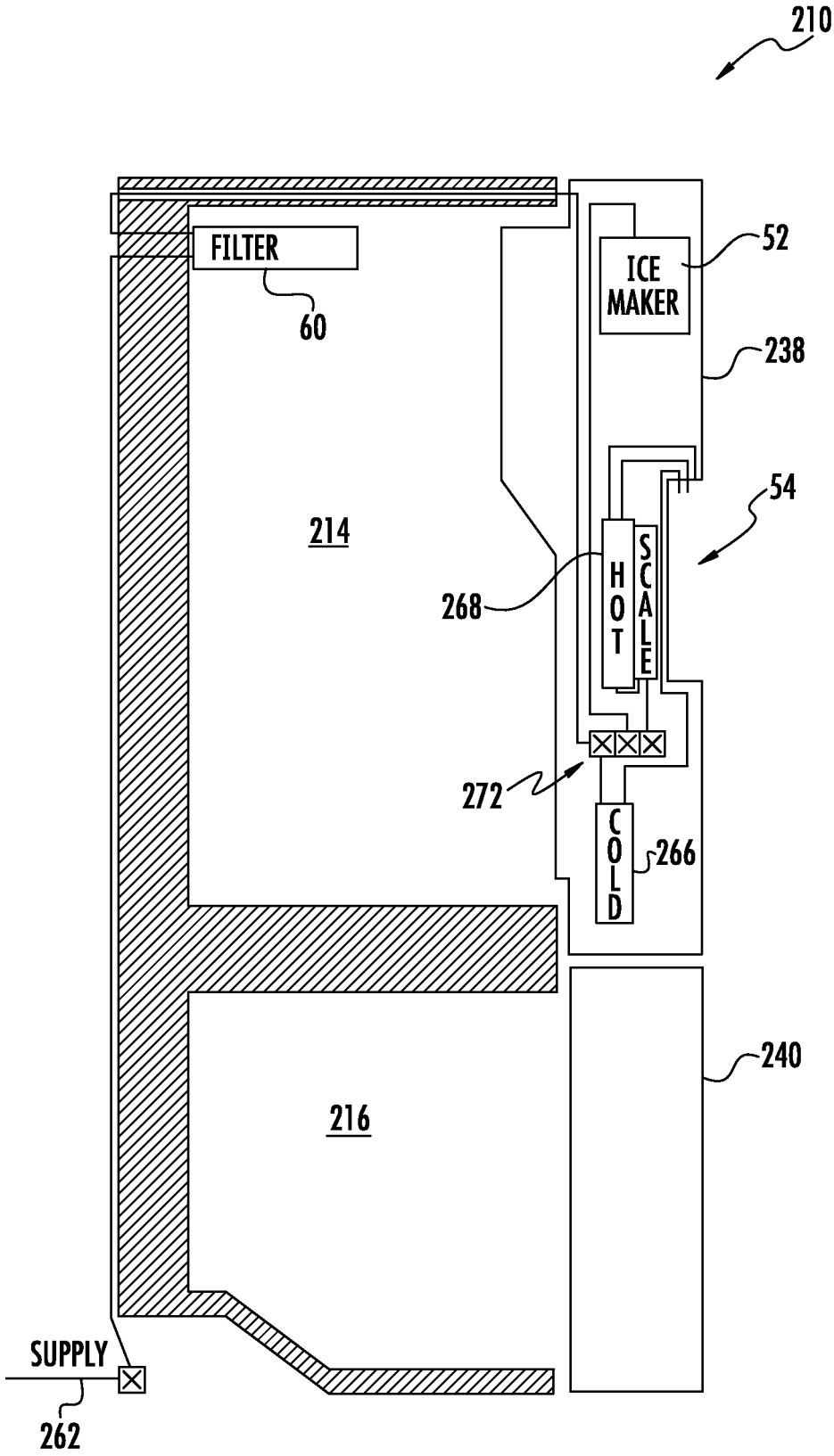
FIG. 10 provides a diagrammatical side view of an alternate refrigeration appliance with a top fresh food compartment and a bottom freezer, and with an alternate a water system according to certain aspects of the disclosure.

A modified refrigeration appliance 210 and water system is shown in FIG. 10. The system of FIG. 10 is similar to that of FIG. 3, except that valving 272 is moved upstream of cold water storage tank 266 for dividing and controlling flows to the cold water storage tank, hot water tank 268 and ice maker 52 at that point. As above, the system can operate on premises line pressure without additional pumping, by virtue of opening solenoid valving accordingly when flow to one of the elements above is desired. Otherwise, the operation of the system of FIG. 10 is similar to that described above. A benefit of the valving arrangement of FIG. 10 (as compared to that of FIG. 3) is that no flow into the water tanks or ice maker of appliance 210 occurs unless the valving is opened, so failure, cracking, etc., in cold water tank will not cause leakage beyond the amount of water therein.

Also, refrigeration appliance 210 is a top refrigerator model, with fresh food compartment 214 on top with an upper door (or French doors if desired) 238, and freezer compartment 216 on bottom with door or drawer 240. Filter 260 is located in the interior of compartment 214 as is conventional, with different water line routing, as shown. It should be clear therefore that the present hot water supply system can be used with various refrigeration appliance designs. The hot water tank itself may be located in various places within the appliance 10/210, for example in or on either door, in or on either compartment, or in the mechanical compartment, or even remote from the refrigeration appliance (which could be desired so as to not add heat to a refrigerated area).

Figure 12:
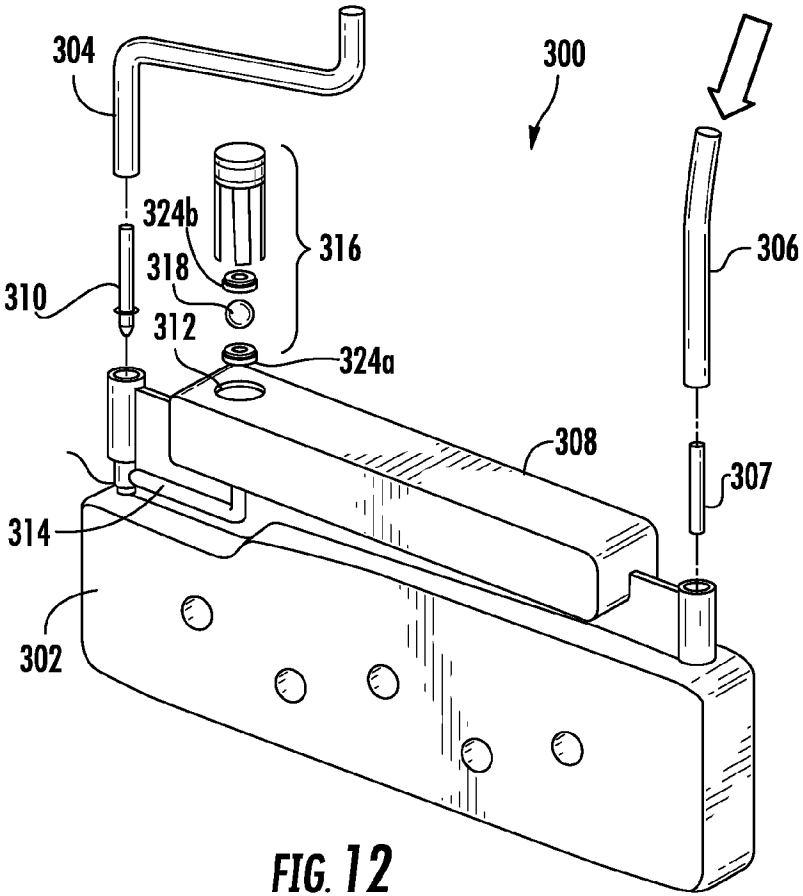
FIG. 12 provides an exploded perspective of the cold water tank of FIG. 11.
Figure 11:
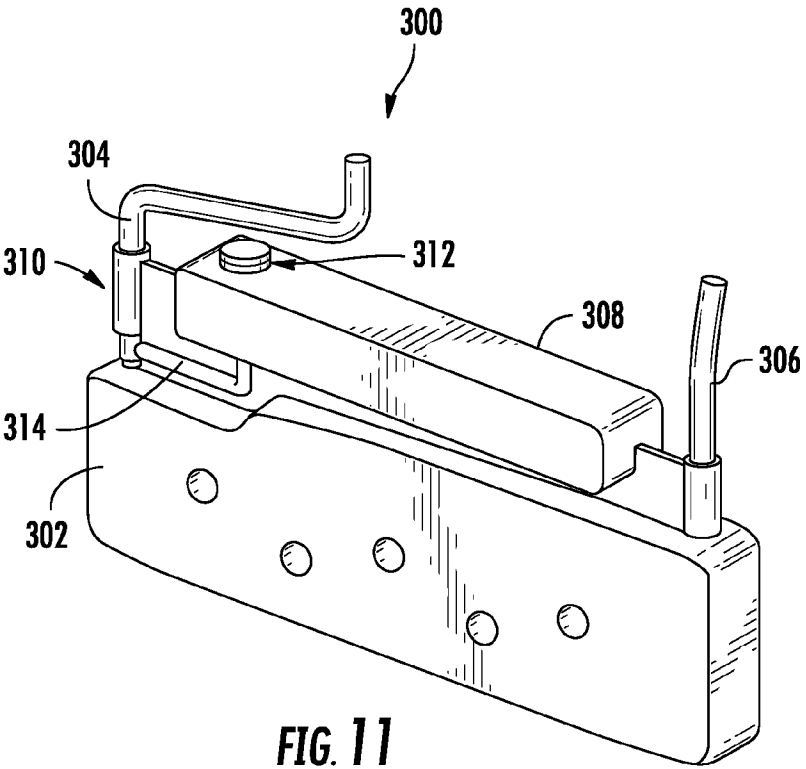
FIG. 11 provides a perspective view of one possible cold water tank.
Figure 13:
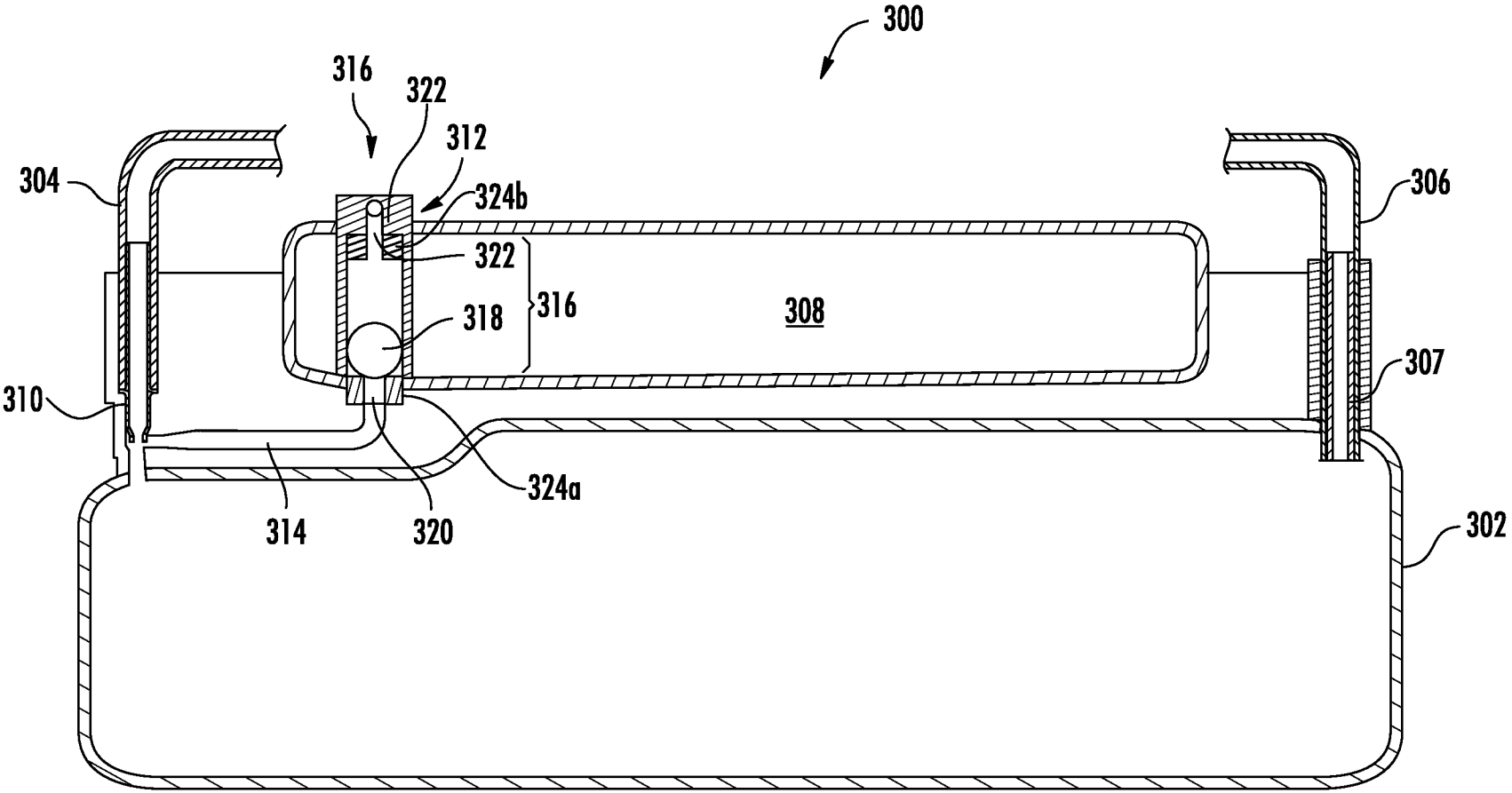
FIG. 13 provides a sectional view of the cold water tank of FIG. 11.

FIGS. 11-13 show a cold water storage tank 366 suitable for use with refrigeration appliances 10 or 210. Tank 300 is similar to hot water storage tank 68 above in that it includes a tank body 302, inlet conduit 304, outlet conduit 306, mounting insert 307, evacuation chamber 308, venturi portion 310, and venting outlet 312 open to atmosphere. As above, as water is supplied to tank 300 via the inlet, a pressure lower than premises line pressure but above atmosphere is created in tank body 302 by venturi portion 310. Water within evacuation chamber 308 and conduit 314 will be drawn back into tank body 302 as water flows though venturi portion 310, as above. A float valve 316 is provided having a float member 318, also as above. Float member 318 (as shown, a ball) can seal lower opening 320 at an end of conduit 314 when evacuation the chamber 308 is empty of water, and can seal upper opening 322 at venting outlet 312 if water fills the evacuation chamber sufficiently to float the ball upward to that extent. Seal members 324*a*, 324*b* can be used at the lower opening 320 and upper opening 322 respectively to be contacted by float member 318, if desired.

Tank body 302 may be formed of a single molded piece of plastic such as high density polyethylene or the like. Venturi portion 310 is shown as a separate piece attached to or overmolded into tank body 302, however the venturi portion could instead be made unitary with the tank body.

In operation, when the cold water storage tank is first filled, a set amount of water could be pumped into tank body 302 via inlet 304 (with air venting out of venting outlet 312) or an amount of water could be pumped in until float member 318 floats upward in evacuation chamber 308 to seal upper opening 322 of vent outlet 312. A sensor (not shown) as above could be provided to sense water level within tank body 302 as well. Then, as a user manipulates the dispenser interface to indicate desire for cold water, a valve is opened such as valves 72 or 272 allowing flow into tank body 302 and out of dispenser 54. Water in evacuation chamber 308 would be drawn back into tank body 302 via suction created by flow past conduit 314. Once evacuation chamber 308 is emptied, float member 318 will seal off conduit 314.

When flow stops, the pressure in the tank body 302 being above that in the evacuation chamber 308 will urge water through conduit 314 into the evacuation chamber. The pressure differential will also into draw water from the conduit between dispenser 54 and the tank body 302 back into the tank body, thereby reducing or eliminating the occurrence of any dripping of water at the dispenser. Further, placement of tank 300 lower than the dispenser will help return water via gravity. Tank 300 is maintained in a cooled location within a refrigeration appliance 10, 210, such as within a fresh food compartment or door, freezer compartment or door, or within any other cooled location where the water will not freeze.

Figure 14:
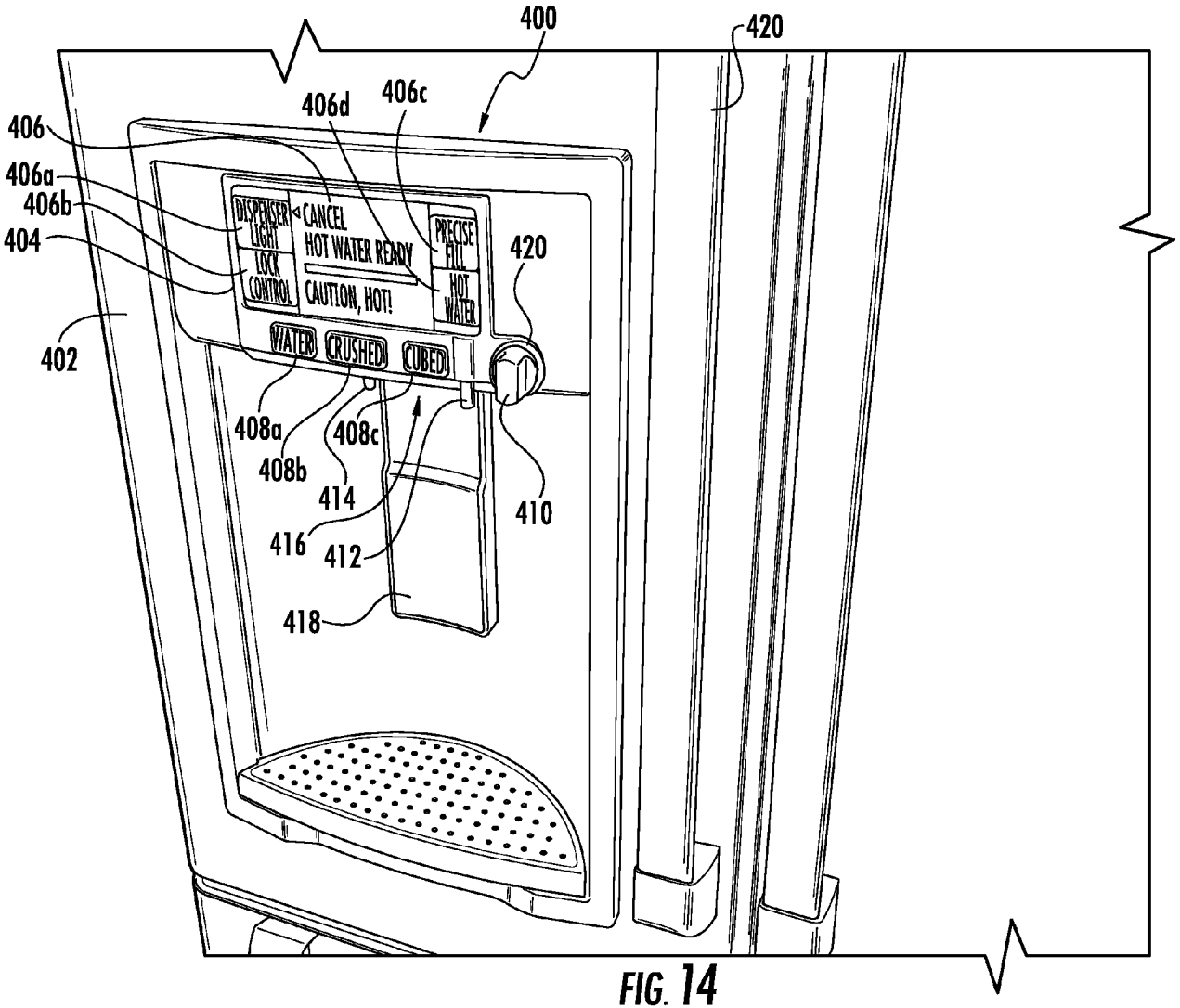
FIG. 14 provides a perspective view of one possible dispenser with input devices for dispensing hot water and other items.

One possible dispenser interface is shown in FIG. 14. As shown therein, dispenser 400 is formed in a door 402 and includes an input device 404 which may if desired have various sub-elements for a user to indicate and control desired dispensing functions. For example, input device 404 may include a screen 406 such as an LCD or the like providing information. If desired, screen 406 may be a conventional touch screen display, or may have touch sensitive areas to the sides. Alternatively or in addition, or one or more buttons or other movable devices 408*a-c* may be provided for input. One such device 410 may be dedicated to hot water dispensing, as described below.

As shown, dispenser 400 includes a hot water outlet 412, and may also include a chilled water outlet 414, and an ice dispensing output 416. A paddle 418 is provided to trigger dispensing of chilled water or ice, as is conventional. Buttons 408*a-c* may be used to indicate whether chilled water, crushed ice or cubed ice, respectively, is to be dispensed. Alternatively, screen 406 or side touch sensitive areas 406*a-d* that may have multiple changing functions depending on user input may be used to indicate desired substance to be dispensed.

As a safety and/or energy saving feature, input device 404 may require two separate actions to be performed before heated water is dispensed. For example, a first action could be done to indicate one or more desired hot water parameters and a second action could be required to dispense the hot water. Hot water parameters can include information such as water temperature or volume. Input as to such subject matter can be obtained in various ways by the elements selected and used in input device 404. For example, via screen 406, areas 406*a-d*, devices 408*a-c*, etc., as user may indicate desire for water of a certain temperature. The temperature can be defined by reference to a measurement unit (e.g., Fahrenheit, Celsius) or a desired substance (e.g., soup, tea, etc.). The volume can be defined by reference to measurement unit (e.g., ounces, milliliters) or to a desired container or product (e.g. cup of tea, mug of tea, cup of soup, bowl of soup, etc.). All of the above input devices may be in communication with a controller, such as 34 described above, or a separate controller or controllers for the water control system.

If desired, the heater for heating the water can be activated by controller 34 only after the user performs the first action to indicate a desired water temperature and/or quantity. Therefore, a heater such as heater 90 above can be turned on only when heated water is desired. Accordingly, the amount of energy to heat water upon demand rather than to maintain water at a given elevated temperature will be substantially less. Further, no need to remove heat from a cooled compartment on a continuous basis would be required with on-demand heating. A slight time delay may be required to sufficiently heat the water in the tank before dispensing depending on desired temperature and volume. Alternately, as described below with reference to FIG. 16, an in-line heating system could be provided for on demand water, rather than a tank based system.

Heated water could be provided pursuant to various criteria. For example, the hot water source could be a tank as in tank 68 with includes at least one temperature sensor such as thermistors 106 in communication with controller such as 34. Accordingly, if desired dispenser 400 may not dispense water until the temperature sensor(s) 106 senses that the water in the tank has reached a desired water temperature indicated by the user in the first action. Alternatively, the dispenser 400 can be controlled so that it will not dispense heated water until the heater has run for a predetermined amount of time corresponding to a water temperature indicated by the user in the first action. Such amount of time would be dependent and/or calculated by the controller based on the volume of water in the tank, previously dispensed, or to be dispensed, typical temperature at which the tank is kept before heating, the period since last use of the heater, etc.

Input device 404 can provide an indication to the user as to when water is sufficiently heated and available for dispensing. For example, to inform the user as to status, screen 406 can include any sort of indicia, such as a count-down or count-up clock, a temperature reading, an indication or readiness or unreadiness, etc. Such indications can be provided elsewhere as well. As shown in FIG. 14, element 410 includes a related indication element 420. As shown, element 410 is in the form of a rotatable element with a circular periphery. An indication element 420 in the form of a lighted circle extends around element 410 and can light up when hot water is ready for dispensing. Indication element 420 can be lit by an incandescent or fluorescent bulb, LED, light tube, etc. Indication element 420 can have any shape or location, and can operate in addition to information provided on screen 406 or elsewhere, or can be the only indicator of hot water readiness if desired. Indication element 420 can be illuminated or can change color or state (flashing, constant, flashing at different speeds), if desired to indicate water heating state.

As a further safety and control feature, element 410 can be designed to require a compound motion before dispensing occurs. For example, element 410 can have a spring-loaded base, whereby an initial push inward and a second twist motion are both required to dispense hot water. Such compound motion tends to reduce or eliminate the possibility of inadvertent dispensing of hot water, for example by an inattentive user. Further, if desired, element 410 can be designed with electro mechanical control such as a servomotor or relay in communication with the controller so that it cannot be moved to the dispensing position until water is sufficiently heated. Once element 410 is placed in the dispensing position and the water is hot enough, the requisite valve is opened allowing flow of heated water out of the water tank, replacement water into the tank, etc., as described above. Dispensing can be stopped either after the user places the element 410 back in the original position, or after an amount of heated water is dispensed as controlled by the controller based on input provided into the input device.

If desired, at least some of the refrigeration equipment 65 within the refrigerated cabinet can be controlled by controller 34 or other controller so as to employ less electrical current when heater 90 is activated. Refrigeration equipment 65 may include one or more of a compressor and a heater for defrost or ice cube harvest, or any electrical device in the refrigeration appliance that can be disabled, powered down, or delayed. Such controlling of the refrigeration equipment can include one or more of deactivating an element, reducing current employed by an element, or delaying activation of an element, so that the overall current drawn during heating of water is reduced. Such reduction can assist in keeping the overall amperage draw for the refrigeration appliance to a lower level, thereby allowing heated water to be provided on an as needed basis while using a typical household circuit. For example, the controller can control various elements so that the refrigeration appliance draws no more than about 80% of a mains outlet rating during heating.

Figure 15:
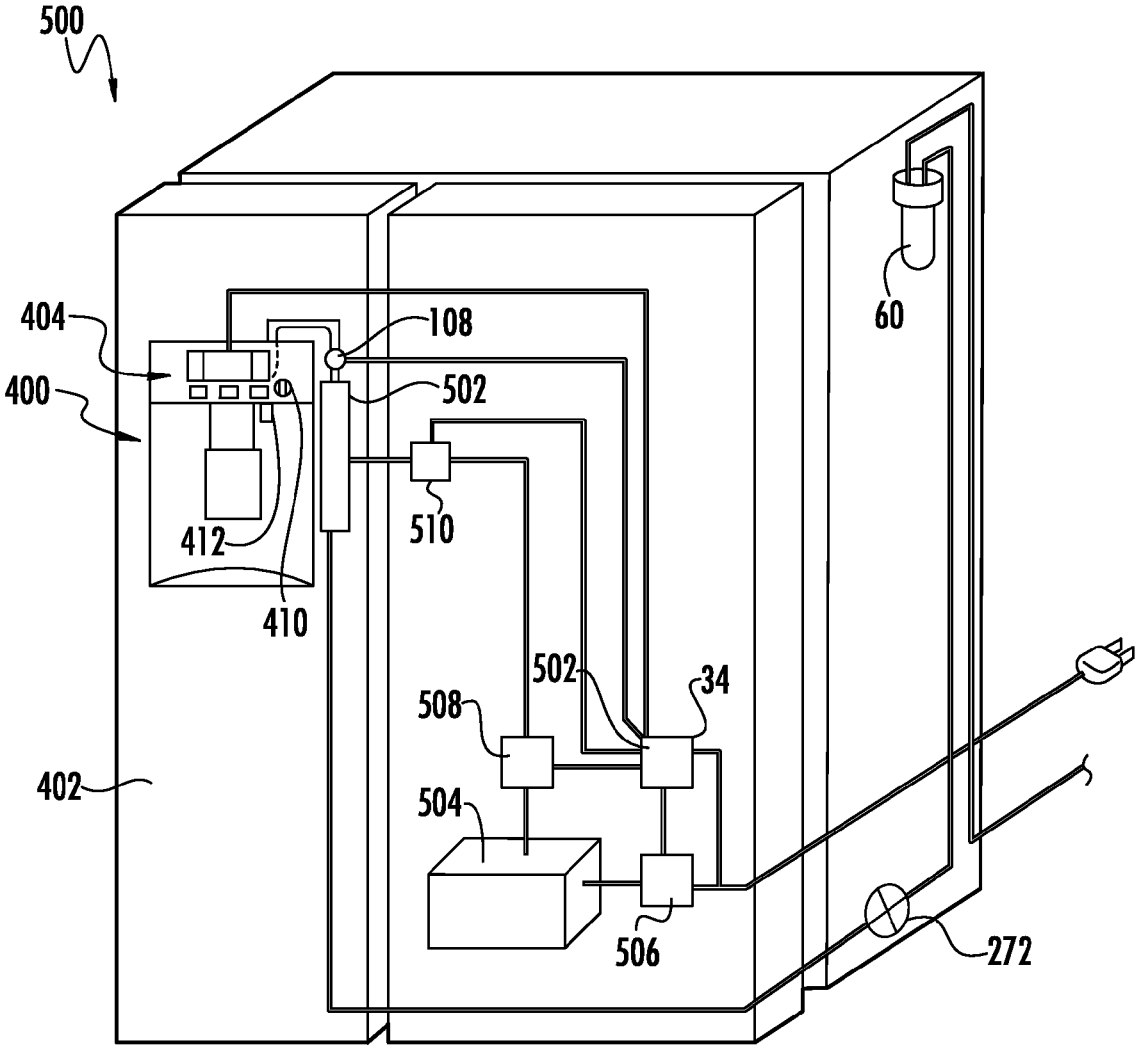
FIG. 15 provides a diagrammatic view of a modified refrigeration device having an energy storage device for at least partially powering the water heater.

As shown in FIG. 15, an alternate refrigeration appliance 500 includes an in-line water heater 502 that can be powered at least in part by an energy storage device 504 such as a battery or capacitor. Device 504 may be charged via a conventional trickle fill circuit 506 and discharged when heating is desired. A power modulation, pulse width circuit 508 can be provided between the energy storage device 504 and electrical heating element within in-line heater 502.

A design capable of heating 8 ounces of water to 195 F from water supplied at 50 F requires roughly 75 BTU. Accordingly, for an inline heater to provide that much heat over approximately 15 seconds, the heat required is about 5 BTU/sec. At standard 110V, a current of over 45 A is required to provide such power, well beyond typical home mains circuits. A design criterion could be the ability to provide 24 ounces of heated water, requiring that level of power usage for up to 45 seconds and three times the BTU's.

Considering a tank based model, assuming a capacity to provide 24 heated ounces of water at a time, over 225 BTU capacity would be required. To heat water using a heater in a tank of 24 ounces in about 10 minutes requires about 3.1 A at 110V (roughly 350 W). Using a higher wattage heater would make the water heat faster but would accordingly draw more current which could be undesirable. Such use of current could be limiting in view of other draws in the refrigeration appliance or burden on the mains circuit. An energy storage device could be used along with or instead of such in-line or tank based systems to heat such amount of water with fewer current issues.

Assuming 75% of discharged energy from a capacitor is available for heating the water, a capacitor rated at roughly 125 Vdc, 53F would be able to store enough energy to heat the 24 ounces of water. If batteries were used and discharge for 45 seconds for the 24 ounces of water were desired, batteries rated at 110 Vdc would need a capacity of roughly 600 mAh (or perhaps substantially more, depending on power made available by the particular battery type at high discharge rates).

These parameters and storage device ratings are subject to changes in design goals and assumptions in various ways. For example, if input water were not cooled or were routed past or held in an auxiliary tank in a warm area near certain of the refrigeration equipment, less energy would be required to warm the water to the maximum temperature accordingly. Also, if a maximum capacity of only two cups were desired, energy requirements would drop by one third. Further, electrical power could be drawn from the electrical mains simultaneous to using the electrical storage device, and other equipment within the refrigeration appliance could be disabled, turned down, or not turned on to reduce total current draw at the time.

As a further safety feature, controller 34 can detect whether a conventional a relay 510 provided for switching a water heating element on or off is operating properly. For example, if controller 34 detects that relay is not turning off ac power to the water heating element, the controller can disable power to the heater via the relay. Therefore, water in the tank will not be excessively heated, wasting energy or causing temperatures to rise too far.

Heating water on demand in-line will likely use substantially less energy than maintaining a water tank at a high temperature, will reduce scale, odor and taste issues, will provide less heat to the refrigeration appliance thereby improving refrigeration cycle efficiency, and will provide a more dynamic temperature modulation.

In view of the above, various options for a multi-function dispenser refrigeration appliance are disclosed wherein the dispensers can provide hot and/or cold water in various scenarios. The designs are subject to modification and application across different models and using different options.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigeration appliance with a hot water dispenser comprising:

a refrigerated cabinet having a dispenser area;

a cabinet water inlet in the refrigerated cabinet connectable to a premises water line; and a hot water storage tank having a tank body defining an interior volume, a heater in the interior volume of the tank body, an inlet for admitting water into the interior volume of the tank body supplied via the cabinet water inlet, and an outlet for providing water via a dispensing conduit to a dispenser in the dispenser area, the inlet including a venturi portion for creating a reduced pressure within the hot water storage tank via flow of water into the hot water storage tank, the reduced pressure being in communication with the dispensing conduit via the outlet so that, after dispensing operation is completed, water remaining in the dispensing conduit is drawn toward the interior volume of the tank body, the hot water storage tank also having an evacuation chamber in communication with the inlet via a conduit extending from the venturi portion, the evacuation chamber positioned above the interior volume of the tank body and having a vent opening such that the evacuation chamber is vented to atmosphere, air within the evacuation chamber being in contact with water in the evacuation chamber, wherein water flows into the evacuation chamber via the conduit and air flows out of the evacuation chamber via the vent opening when the reduced pressure draws water from the dispensing conduit toward the interior volume of the tank body, wherein water flows out of the evacuation chamber via the conduit and air flows into the evacuation chamber via the vent opening when water from the cabinet water inlet flows through the venturi portion.

2. The refrigeration appliance of claim 1, wherein the water storage tank outlet is located in the refrigerated cabinet below the dispenser.

3. The refrigeration appliance of claim 1, wherein the evacuation chamber has a float valve therein for selectively closing a liquid opening in an end of the conduit, a that body in the float valve floating upward to open the liquid opening and to allow water to enter the evacuation chamber via the liquid opening when pressure in the interior volume of the tank body is higher than in the evacuation chamber.

4. The refrigeration appliance of claim 3, wherein the float body seals the liquid opening when water has been removed from the evacuation chamber by flow of water through the venturi portion.

5. The refrigeration appliance of claim 3, wherein the evacuation chamber is configured large enough to receive an amount of water remaining in the dispensing conduit after dispensing.

6. The refrigeration appliance of claim 3, wherein the float body seals the vent opening if sufficient water flows into the evacuation chamber.

7. The refrigeration appliance of claim 1, further including a heat transfer element for removing heat from the hot water storage tank.

8. The refrigeration appliance of claim 7, wherein the heat transfer element includes at least one of a metallic tape and a foil adhesive.

9. The refrigeration appliance of claim 1, wherein the tank body includes a descaling inlet port for receiving a descaling agent.

10. The refrigeration appliance of claim 9, further including a fill port accessible to a user, descaling agent placed in the fill port being transmitted to the tank body via the descaling inlet port.

11. The refrigeration appliance of claim 1, wherein the hot water storage tank is configured to dispense steam for cleaning the dispenser area.

12. The refrigeration appliance of claim 11, further including a cover for covering the dispenser area before steam is dispensed.

13. The refrigeration appliance of claim 12, further including a sensor located for detecting whether the cover is covering the dispenser area, and further including a controller in communication with the sensor, the controller allowing steam to be dispensed only if the sensor detects that the cover is covering the dispensing area.

14. The refrigeration appliance of claim 11, further including a supplemental heater for creating the steam.

15. The refrigeration appliance of claim 1, further including a valve between the cabinet water inlet and the hot water tank inlet, the valve being selectively openable to provide water from the premises line to the interior volume of tank body at the premises line pressure without further pumping.

16. The refrigeration appliance of claim 1, wherein the tank body is made of a plastic, and further including a metallic liner within the tank body to shield the tank body from the heater.

17. The refrigeration appliance of claim 1, wherein the tank body is located on a door covering a refrigerated compartment of the refrigerated cabinet.

* * * * *